United States Patent [19]

Nilsson et al.

[11] Patent Number: 5,057,164

[45] Date of Patent: Oct. 15, 1991

[54] PROCESS FOR THERMAL TREATMENT OF METALS

[75] Inventors: Tom Nilsson, Helsingborg, Sweden; Yannick Rancon, Velizy; Eric Duchateau, Versailles, both of France

[73] Assignee: L'Air Liquide, Societe Anonyme pour l'Etude et l'Exploitation des Procedes Georges Claude, Paris, France

[21] Appl. No.: 543,434

[22] Filed: Jun. 26, 1990

[30] Foreign Application Priority Data

Jul. 3, 1989 [FR] France ..... 89 08877

[51] Int. Cl.[5] ..... C21D 9/00

[52] U.S. Cl. ..... 148/16; 148/20.3

[58] Field of Search ..... 148/16, 20.3

[56] References Cited

U.S. PATENT DOCUMENTS 4,445,945 5/1984 Schwalm ..... 148/16

FOREIGN PATENT DOCUMENTS 59-153842 9/1984 Japan ..... 148/16

62-136528 6/1987 Japan ..... 148/16

*Primary Examiner*—Deborah Yee

*Attorney, Agent, or Firm*—Oblon, Spivak, McClelland, Maier & Neustadt

[57] ABSTRACT

Process for thermal treatment of metals by passage of metallic pieces into an elongated zone under a controlled atmosphere, having an upstream section at an elevated temperature, where the controlled atmosphere comprises nitrogen and reductive chemicals, particularly hydrogen, possibly carbon monoxide; and a downstream section at a lower temperature under a controlled atmosphere. The invention is characterized by the fact that in the upstream section at an elevated temperature, the atmosphere comprises nitrogen having a residual content of oxygen between 0.5% and 5% produced by separation of air using permeation or adsorption techniques. The reductive chemicals are present at all times in a content at least sufficient to eliminate the oxygen admitted with the nitrogen. The controlled atmosphere in the section downstream from the elongated thermal treatment zone is formed by admission of a gaseous flow taken from the upstream section at an elevated temperature and transferred directly into the downstream section at a lower temperature.

12 Claims, No Drawings

PROCESS FOR THERMAL TREATMENT OF METALS

BACKGROUND OF THE INVENTION

1. Field of the Invention

The invention relates to thermal treatment of metals in a controlled atmosphere.

2. Discussion of the Background

A controlled atmosphere is essential for the annealing of metallic pieces. It is conventionally done in the following manner:

either by using an exothermic generator providing incomplete combustion of a hydrocarbon and air that yields combustion gases which, possibly after purification, contain hydrogen and carbon monoxide. Both of these gases are reducers at their respective concentrations which depend on the ratio of air/hydrocarbon admitted into the generator. As an example, such an exothermic atmosphere can contain 5 to 10% carbon monoxide and 6 to 12% hydrogen;

or by creating a synthetic atmosphere based on pure industrial gases such as nitrogen and hydrogen. Nitrogen is produced by cryogenic distillation of air and contains very few impurities. For example, the total of water vapor and oxygen impurities is generally less than 10 ppm by volume. Hydrogen, or a hydrocarbon, or hydrogen and a hydrocarbon, or methanol is added to this very pure nitrogen in such a manner as to produce a reductive atmosphere and, if necessary, to produce a non-decarbonizing atmosphere, which is used to treat the metallic pieces.

This second method of operation has the advantage of completely controlling the quality of the treatment atmosphere but has the disadvantage of using cryogenic nitrogen, which is relatively expensive. This is the reason why an effort is usually made to reduce the flow of gas admitted to the system by creating a nitrogen cushion, particularly at the exit from the cooling zone, in order to prevent any back-flow of air through the cooling zone. This procedure results in a significant reduction of the overall flow admitted. However, in spite of this major reduction in flow, industrially pure gases are still far from being economically attractive relative to gases produced by an exothermic generator.

This is the reason why, in certain applications where this has proven to be possible, it has been proposed to replace the cryogenic nitrogen with nitrogen produced by separation of air according to adsorption or selective permeation techniques. Under certain production conditions, these techniques are less costly than cryogenic nitrogen. However this is at the detriment of oxygen impurity, since nitrogen produced by adsorption usually contains a residual content of oxygen of 0.5% to 5% while the residual content of oxygen in nitrogen produced by permeation generally exceeds 3% and can go as high as 10%.

This oxygen impurity makes it very difficult to use the raw nitrogen directly for producing a suitable thermal treatment atmosphere. In practice, it has been proposed that nitrogen produced according to the selective permeation process be used only for production of atmospheres produced from nitrogen and methanol, as is described in the article "Heat Treating Processes With Nitrogen and Methanol Based Atmosphere" M. Kostelitz et at. in *Journal of Heat Treating,* Volume 2, No. 1–35, and in the French Patents 79.05.599, 82.12.380 and 85.12.379, in the name of the applicant. Such an atmosphere formed on the basis of nitrogen with a residual content of oxygen and containing methanol can, theoretically, be used in different applications, namely heating before quenching, carbonitriding, and steel cementation. But it is only in the latter area that the use of nitrogen with a residual content of oxygen has been used industrially, and this is due to the fact that the elevated temperature which cementation implies, on the order of 900° C., promotes reaction of the residual oxygen carried by the nitrogen with chemicals of the hydrocarbon type which are simultaneously admitted to form the base atmosphere.

It has been proposed to purify the nitrogen produced by adsorption or permeation, having a residual content of oxygen, by having the oxygen react catalytically with a corresponding supply of hydrogen sufficient to assure complete elimination of all the oxygen. But this relatively expensive process results in a production cost almost equal to that of cryogenic nitrogen, which speaks against this form of production of pure nitrogen, especially since production of nitrogen by adsorption or permeation does not have the advantages of flexibility and simplicity that production of cryogenic nitrogen has.

SUMMARY OF THE INVENTION

The invention provides thermal treatment of metals by continuous passage of metallic pieces into an elongated zone comprising a controlled atmosphere, having an upstream section at an elevated temperature, where the controlled atmosphere comprises nitrogen derived by separation of air using permeation or adsorption techniques and reductive chemicals, particularly hydrogen, possibly carbon monoxide; and a downstream section at a lower temperature under a controlled atmosphere.

DETAILED DESCRIPTION OF THE PREFERRED EMBODIMENTS

The present invention provides a process of thermal treatment of metals that makes it possible to substantially reduce the cost of the treatment atmosphere, while assuring the required qualities of the atmosphere, which must be free of oxygen both in the upstream section at an elevated temperature and in the downstream section at a lower temperature. The process according to the invention is characterized by the fact that in the upstream section at an elevated temperature, the atmosphere comprises nitrogen derived from admission of nitrogen that was produced by separation of air using permeation or adsorption techniques and which initially had a residual oxygen content of 5% or less, and preferably greater than 0.5%. The reducing chemicals are, at all times, present in a concentration sufficient to eliminate the oxygen admitted with the nitrogen. The controlled atmosphere in the section downstream from the elongated thermal treatment zone is formed by admission of a gaseous flow taken from the upstream section at an elevated temperature, and transferred directly into the downstream section at a lower temperature. Thus by adding reductive chemicals in the high temperature zone, such as hydrogen or carbon monoxide, or creating them on location in sufficient quantities, almost instantaneous and almost complete elimination of the oxygen that was admitted with the nitrogen is assured because it is transformed into water vapor and carbonic gas. This process occurs while maintaining a sufficient content of the reductive chemicals that the $H_2/H_2O$ and $CO/CO_2$ ratios remain within suitable limits to assure the required treatment effect without causing oxidation of the pieces during treatment. In the zone at a less elevated temperature, which is clearly lower and in any case insufficient to assure an immediate reaction between the residual oxygen carried by the nitrogen and the reductive chemicals which might be present, this difficulty is overcome by taking an appropriate flow from the zone at an elevated temperature, which is transferred, purely and simply, to the zone at a less elevated temperature.

According to the invention, the flow taken from the upstream section at an elevated temperature is between 2% and 75% of the total flow admitted to the upstream section at an elevated temperature.

According to one embodiment, the flow taken from the upstream section at an elevated temperature is between 2% and 35% of the total flow admitted to the upstream section at an elevated temperature.

According to another embodiment, the flow taken from the upstream section at an elevated temperature is between 25% and 75% of the total flow admitted to the upstream section at an elevated temperature.

In one form of application, the elongated zone is a continuous zone with an upstream section at an elevated temperature and a downstream section for cooling.

In another form of application, the elongated zone is discontinuous and comprises an upstream zone at an elevated temperature and a downstream zone at a less elevated temperature. According to a more particular form of application, the upstream treatment zone at an elevated temperature and the downstream zone at a less elevated temperature are separated from one another by a treatment post outside of the controlled atmosphere, for example a liquid bath.

Preferably, and no matter what form of implementation is used for the application, the taking of the gaseous flow from the upstream zone at an elevated temperature in order to transfer it to the downstream zone at a less elevated temperature, is carried out downstream from a point of admission of the gases which comprise the controlled atmosphere in the zone at an elevated temperature. Preferably, the taking of the gaseous flow outside of the upstream zone at an elevated temperature in order to transfer it to the downstream zone at a less elevated temperature is carried out between two points of admission of the gases which comprise the controlled atmosphere in the zone at an elevated temperature.

Having generally described this invention, a further understanding can be obtained by reference to certain specific examples which are provided herein for purposes of illustration only and are not intended to be limiting unless otherwise specified.

EXAMPLE 1

Annealing of Steel with a Low Carbon Content ($\leqq$0.3%)

A gas flow of 60 $m^3/h$ is admitted to several points in the upstream zone of a furnace that is at an elevated temperature. A portion (70%) of this flow (i.e., 42 $m^3/h$) is nitrogen obtained by permeation or adsorption, with a residual oxygen content of 0.5%, while the remaining 30% (i e., 18 $m^3/h$) is comprised of 12 $m^3/h$ hydrogen and 6 $m^3/h$ carbon monoxide resulting from cracking of 10.6 l/h methanol admitted with the nitrogen.

From the zone at an elevated temperature, 5 $m^3/h$ (8.3% of the total flow) is taken by way of a tap located between two injection points. This gas is transported and reinjected into the exit of the furnace in order to prevent any oxidation in the cooling zone.

EXAMPLE 2

Heating before Quenching of Thin Steel Strips, Followed by Quenching and Tempering Here, the plate undergoes heating before quenching at 950° C., in an upstream treatment zone at an elevated temperature, formed of a first furnace. The strip is then quenched at the exit from the first furnace in a bath of liquid lead, before being tempered at 400° C. in a second treatment zone formed of a second furnace.

30 $m^3/h$ of atmosphere is admitted at two separated points of the first furnace. This atmosphere is comprised of 70% nitrogen obtained by permeation or adsorption (21 $m^3/h$), with a residual oxygen content of 0.5%, and of 30% hydrogen (6 $m^3/h$) and CO (3 $m^3/h$) resulting from cracking of 5.3 l/h vaporized methanol. The temperature of 950° C. is sufficient to assure correct cracking of the methanol as well as reaction of the residual oxygen with the reductive chemicals present ($H_2$ and CO). In the second furnace, in contrast, the temperature of 400° C. is insufficient and tempering treatment with industrial gases would require the use of cryogenic nitrogen and hydrogen, which is not acceptable from an economic point of view.

According to the invention, the treatment atmosphere of the first furnace is used in the second furnace by taking 15 $m^3/h$ of the atmosphere of the first furnace (i.e., 50% of the total flow injected) by extraction, at an intermediate point, in order to inject it into the second furnace.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for thermal treatment of metals using nitrogen produced by permeation or adsorption techniques comprising: passing metallic pieces into an elongated zone under a controlled atmosphere, said elongated zone having an upstream section at an elevated temperature and a downstream section at a lower temperature, wherein said controlled atmosphere is formed essentially by admission into the upstream section of reductive chemicals and of nitrogen having a maximum residual oxygen content of 5% by volume produced from air by permeation or adsorption techniques, said reductive chemicals begin present at all times in an amount sufficient to substantially eliminate the residual oxygen admitted with the nitrogen, and wherein the controlled atmosphere in said downstream section is formed by admission of a gaseous flow taken from said upstream section at an elevated temperature and transferred directly to said downstream section at a lower temperature.

2. A process of annealing metallic pieces according to the thermal treatment process of claim 1, wherein metallic pieces at elevated temperatures are quenched at a lower temperature before being tempered, comprising: passing said metallic pieces through an upstream section at an elevated temperature; quenching in a liquid metal bath; then tempering in a downstream section wherein nitrogen produced using permeation or adsorption techniques having a maximum residual oxygen content of 5% by volume is admitted long with methanol into the upstream section at an elevated temperature, which provides heating before quenching, with removal from the atmosphere of the upstream section of a flow which is reinjected int said downstream section which provides tempering of said metallic pieces.

3. Process for thermal treatment of metals according to claim 1, characterized by the fact that the residual content of the nitrogen which comprises the atmosphere of the upstream section an elevated temperature is greater than 0.5% by volume.

4. Process for thermal treatment of metals according to claim 1, wherein the flow taken from the upstream section at an elevated temperature is between 2% and 75% by volume of the total flow admitted to the upstream section at an elevated temperature.

5. Process for thermal treatment of metals according to claim 4, wherein the flow taken from the upstream section at an elevated temperature is between 2% and 35% by volume of the total flow admitted to the upstream section at an elevated temperature.

6. Process for thermal treatment of metals according to claim 4, wherein the flow taken from the upstream section at an elevated temperature is between 25% and 75by volume of the total flow admitted to the upstream section at an elevated temperature.

7. Process for thermal treatment of metals according to claim 1, wherein the elongated zone is a continuous zone, with an upstream section at an elevated temperature and a downstream section for cooling.

8. Process for thermal treatment of metals according to claim 4, wherein the elongated zone is discontinuous and comprises an upstream treatment zone at an elevated temperature and a downstream treatment zone at a less elevated temperature.

9. Process for thermal treatment of metals according to claim 8, wherein the upstream treatment zone at an elevated temperature and the downstream zone at a less elevated temperature are separated from one another by a treatment post outside of the controlled atmosphere.

10. Process for thermal treatment of metals according to claim 1, wherein the taking of the gaseous flow outside of the upstream zone at an elevated temperature, in order to transfer it to the downstream zone at a less elevated temperature, is carried out downstream from a point of admission of the gases which comprise the controlled atmosphere in the zone at an elevated temperature.

11. Process for thermal treatment of metals according to claim 10, wherein the taking of the gaseous flow outside of the upstream zone at an elevated temperature, in order to transfer it to the downstream zone at a less elevated temperature, is carried out between two points of admission of the gases which comprise the controlled atmosphere in the zone at an elevated temperature.

12. A process of annealing metallic pieces according to the thermal treatment process of claim 1, wherein the atmosphere in the upstream zone at an elevated temperature comprises nitrogen produced by using permeation or adsorption techniques and has a residual content of oxygen; and further comprises methanol which decomposes by cracking into hydrogen and carbon monoxide, whereby the hydrogen and the carbon monoxide react with the residual oxygen to form water vapor and carbon dioxide, and wherein a partial flow of the atmospheric gases is taken from said upstream zone in order to reinject it at the end of the downstream cooling zone.

* * * * *